US007708064B2

(12) United States Patent
Sehsah

(10) Patent No.: US 7,708,064 B2
(45) Date of Patent: May 4, 2010

(54) WELLBORE PIPE CENTRALIZER HAVING INCREASED RESTORING FORCE AND SELF-SEALING CAPABILITY

(75) Inventor: Ossama Ramzi Sehsah, Katy, TX (US)

(73) Assignee: At Balance Americas, LLC

( * ) Notice: Subject to any disclaimer, the term of this patent is extended or adjusted under 35 U.S.C. 154(b) by 129 days.

(21) Appl. No.: 11/965,019

(22) Filed: Dec. 27, 2007

(65) Prior Publication Data

US 2009/0166027 A1 Jul. 2, 2009

(51) Int. Cl.
*E21B 17/10* (2006.01)

(52) U.S. Cl. ..... 166/241.6

(58) Field of Classification Search ..... 166/241.1, 166/241.6

See application file for complete search history.

(56) References Cited

U.S. PATENT DOCUMENTS 2,174,085 A * 9/1939 Hartman ..... 166/241.6
2,228,648 A * 1/1941 Welles ..... 166/241.6
2,516,034 A * 7/1950 Van Every ..... 166/241.1
2,636,564 A * 4/1953 Kluck ..... 166/241.6
3,556,042 A 1/1971 Laughlin
4,794,986 A 1/1989 Langer
6,102,118 A 8/2000 Moore
6,367,556 B1 4/2002 Moore
6,997,254 B2 * 2/2006 Jenner ..... 166/241.6

* cited by examiner

*Primary Examiner*—David J Bagnell
*Assistant Examiner*—Blake Michener
(74) *Attorney, Agent, or Firm*—Richard A. Fagin

(57) ABSTRACT

A centralizer includes two stop collars configured to be affixed to an exterior surface of a pipe. A plurality of circumferentially spaced apart spacers is each coupled at each end to one of the stop collars, a first plurality of circumferentially spaced apart bow springs is each coupled at one end thereof to the first stop collar and at an opposite end thereof to a first floating collar disposed between the first and second stop collars. A second plurality of circumferentially spaced apart bow springs is each coupled at one end thereof to the second stop collar and at an opposite end thereof to a second floating collar disposed between the first and second stop collars. A shape of the bow springs is selected to cooperatively engage the spacers and the floating collars such that when compressed the centralizer provides a substantially fluid-tight seal.

5 Claims, 2 Drawing Sheets

WELLBORE PIPE CENTRALIZER HAVING INCREASED RESTORING FORCE AND SELF-SEALING CAPABILITY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of pipe centralizers used to position pipes within wellbores drilled into the Earth. More specifically, the invention relates to structures for pipe centralizers that have increased restoring force, without corresponding increase in running force. The invention also relates to structures for centralizers that are self-sealing to enable moving through a wellbore pipe string sealing device.

2. Background Art

Centralizers are used to laterally or radially position a pipe or pipe "string" within a wellbore drilled into the Earth. A common type of centralizer is the so-called "bow spring" centralizer. A bow spring centralizer includes a plurality of circumferentially spaced apart single-leaf springs coupled to one or more devices arranged to affix the springs to the exterior of the pipe to be positioned in the wellbore. The leaf springs provide a force known as "restoring force" to laterally urge the pipe away from the wall of the wellbore. At the same time, the bow springs are laterally compressible so that the pipe may be moved along the interior of the wellbore notwithstanding the presence in the wellbore of small diameter restrictions and other obstacles to longitudinal movement of the pipe along the wellbore.

Examples of bow spring centralizers are described in U.S. Pat. No. 7,159,668 issued to Herrera and U.S. Pat. No. 6,457,519 issued to Buytaert. The centralizer described in the '519 patent is intended to address a particular problem associated with bow spring centralizers, namely how to minimize the "staring force", which is the force required to insert the centralizer into interior of the wellbore and the "running force", which is the amount of force required to move the pipe longitudinally along the wellbore with such centralizers affixed to its exterior, while maximizing the restoring force. Specifications for the amount of restoring force, and proper use of centralizers are described in a document entitled, Specifications for Bow-Spring Centralizers, API Specification 10D, fifth edition, American Petroleum Institute, Washington, D.C. (1994). Generally speaking, casing centralizers are made to center a particular outside diameter (OD) pipe within a particular nominal diameter wellbore or outer pipe. The pipe OD is selected by the wellbore operator to closely match, for example, the wellbore diameter, which primarily related to the diameter of the drill bit used to drill a particular segment of the wellbore.

More recently, techniques have become known in the art to drill wellbores while maintaining a selected fluid pressure in an annular space between the wellbore wall and the pipe used to drill the wellbore. See, for example, U.S. Pat. No. 6,904,981 issued to van Riet and U.S. Pat. No. 6,352,129 issued to Best. Drilling techniques such as those disclosed in the foregoing patents typically require the use of a "rotating control head" at the upper end of the wellbore in order to control the pressure in the body of fluid in the annular space. A rotating control head is a device which closes the annular space while simultaneously enabling longitudinal and rotational movement of the pipe therethrough. Using a rotating control head with centralizers affixed to the exterior of the pipe may present particular difficulties in providing sufficient restoring force while maintaining the ability to sealingly move the pipe through the rotating control head.

SUMMARY OF THE INVENTION

A centralizer according to one aspect of the invention includes a first stop collar configured to be affixed to an exterior surface of a pipe. A second stop collar is spaced apart from the first stop collar and is configured to be affixed to the exterior surface of the pipe. A plurality of circumferentially spaced apart longitudinal spacers is included and each is coupled at each longitudinal end to one of the stop collars. A first plurality of circumferentially spaced apart bow springs is each coupled at one longitudinal end thereof to the first stop collar and at an opposite longitudinal end thereof to a first floating collar disposed between the first and second stop collars. A second plurality of circumferentially spaced apart bow springs is each coupled at one longitudinal end thereof to the second stop collar and at an opposite longitudinal end thereof to a second floating collar disposed between the first and second stop collars.

Other aspects and advantages of the invention will be apparent from the following description and the appended claims.

DETAILED DESCRIPTION

Figure 1:
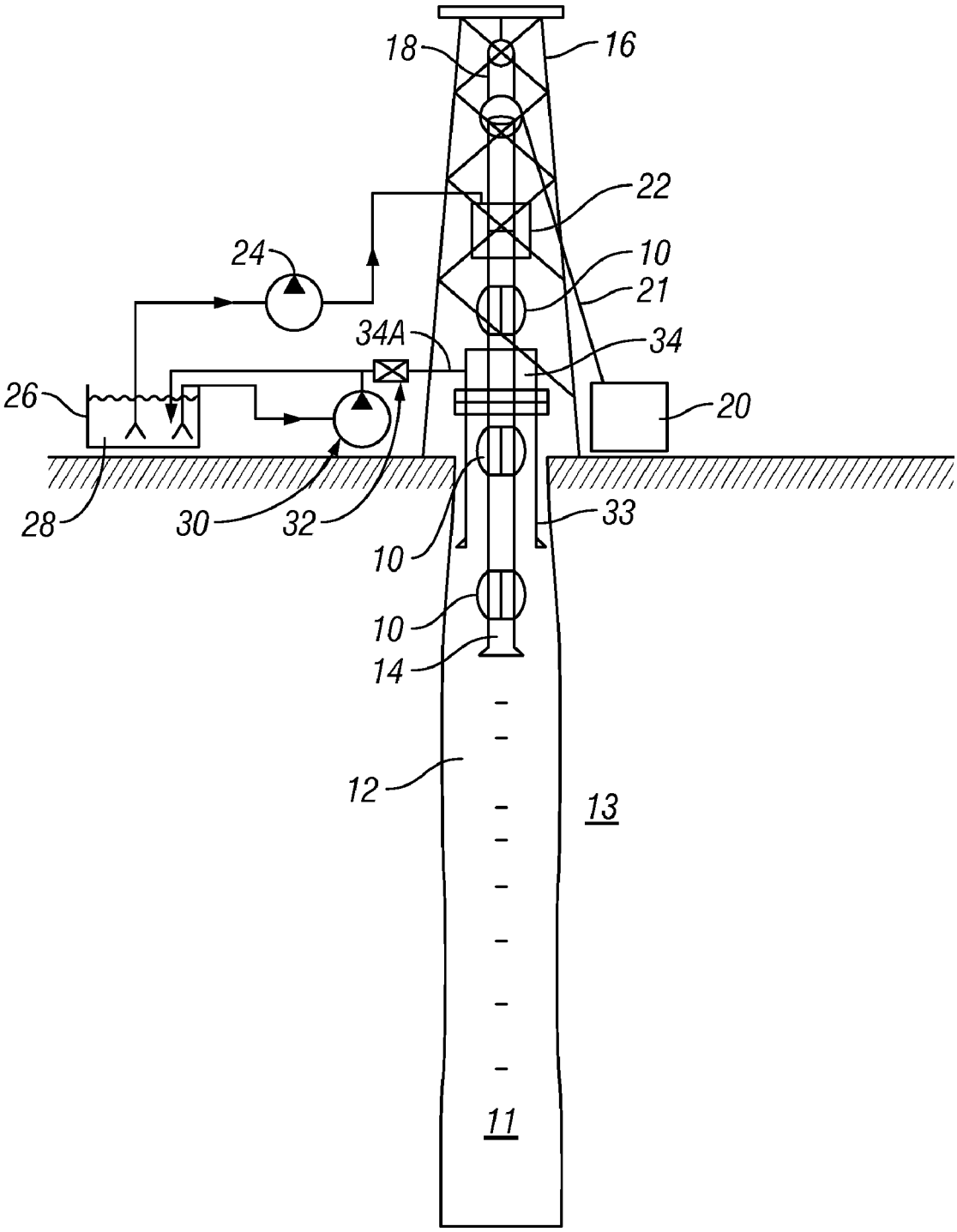
FIG. 1 shows a typical wellbore operation in which centralizers according to the invention may be used on a pipe inserted into the wellbore.

An example wellbore operation in which centralizers according to the invention can be used is shown schematically in FIG. 1. A wellbore 12 may be drilled into subsurface Earth formations 13 to a depth to which a protective pipe or casing 14 is intended to be set. The pipe or casing 14 may include one or more centralizers 10 which will be explained in more detail below with reference to FIG. 2. The pipe 14 may be lowered into the wellbore 12 by a hoisting system such as a drilling rig 16 or the like. The drilling rig 16 may include a drawworks 20 or similar winch that extends and retracts a drill line 21. Movement of the drill line 21 cooperates with sheaves or "blocks" 18 to cause upward and downward motion of a top drive 22 or similar device to provide rotational motion to the pipe 14.

Typically during operations, the wellbore 12 is filled with fluid 11 such a "drilling mud" or other fluid used to drill and/or complete the wellbore 12. The fluid 11 is typically lifted from a pit or tank 26 disposed at the surface. The tank 16 may include a supply 28 of cleaned or conditioned fluid. The fluid 28 is lifted by a pump 24 which discharges the fluid to the top drive 22. Internal rotating seal elements in the top drive 22 enable the fluid to be pumped through the interior of the pipe 14.

The wellbore 12 typically includes a casing 33 ("surface casing") set to a relatively limited depth near the surface. An upper end of the surface casing 33 is coupled to a sealing element called a rotating control head 34. The rotating control head 34 seals against the exterior of the pipe 14 to prevent escape of fluid 11 from the wellbore 12. The rotating control head 34 may include a fluid discharge outlet 34A coupled through a controllable choke 32 or similar variable restriction flow control device that ultimately can return the fluid 11 to the tank 26. In some examples, the fluid discharge outlet 34A may include a pump 30 coupled thereto at its discharge side so that fluid pressure in the wellbore 12 outside the pipe 14 may be maintained at a selected amount. Methods for controlling such pressure and devices therefor are well described in U.S. Pat. No. 6,904,981 issued to van Riet and U.S. Pat. No. 6,352,129 issued to Best, incorporated herein by reference.

Figure 2:
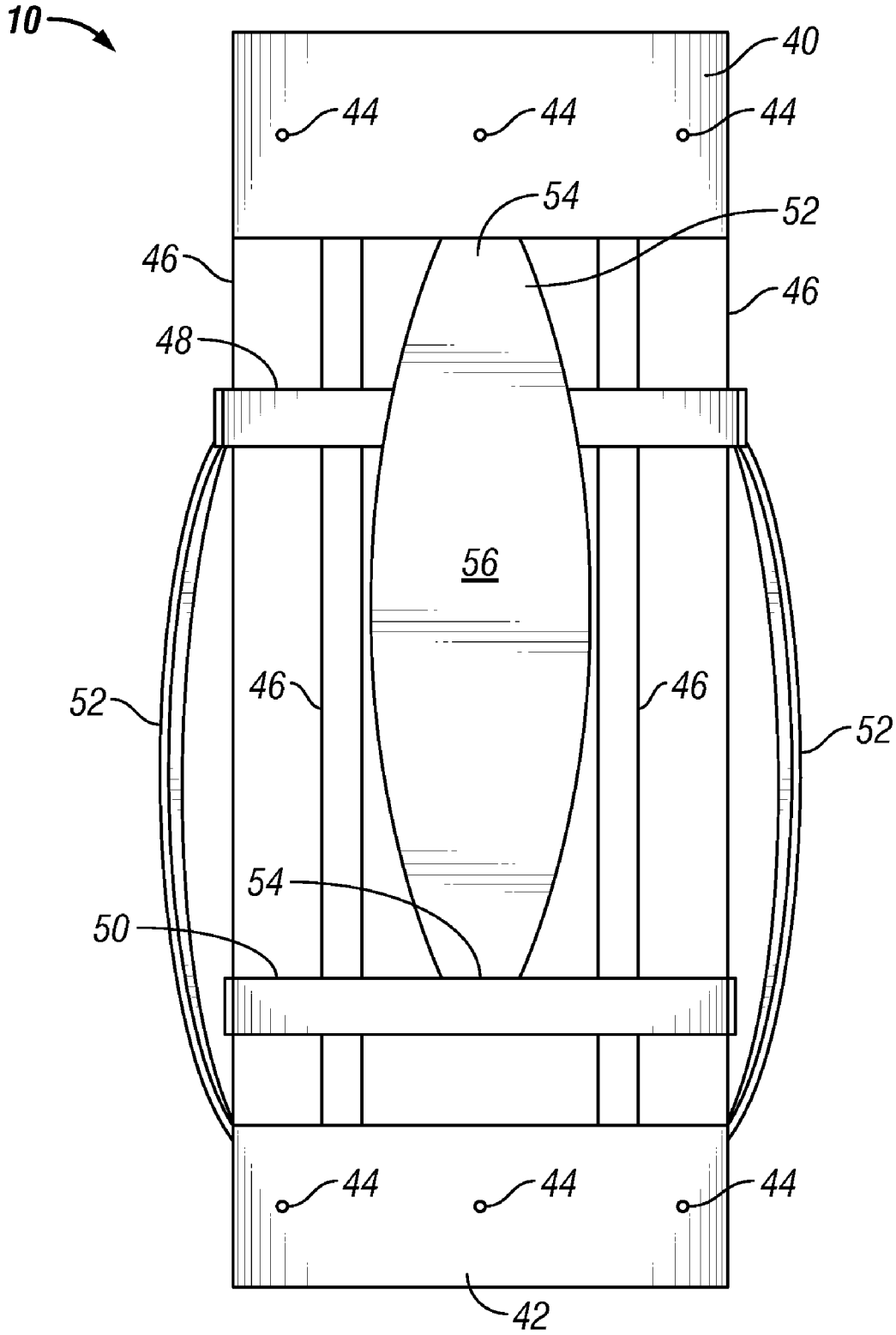
FIG. 2 shows one example of a centralizer.

The example shown in FIG. 1 includes pipe in the form of a casing being inserted into the wellbore 12. It should be clearly understood that the invention is equally applicable to any type of pipe being inserted into a wellbore, including as non-limiting examples drill pipe, coiled tubing, production tubing and rod strings. Accordingly, the invention is not limited in scope to being used with casing. A purpose for a centralizer according to the invention, to be explained with reference to FIG. 2, is to enable increased restoring force without increasing starting or running force. When centralizers are used with a pipe in the example operation shown in FIG. 1, it is desirable to minimize starting and running force in particular because of the rotating control head 34. By minimizing such starting and running force, wear and possible damage to the rotating control head 34 may be reduced.

A side view of an example centralizer according to the invention is shown in FIG. 2. The centralizer 10 may include a first "stop collar" 40 and a second stop collar 42 disposed at a selected longitudinal distance from the first stop collar 40. The stop collars 40, 42 may be made from steel or similar high strength material. The stop collars 40, 42 may be generally cylindrically shaped and may have an internal diameter selected to fit about the exterior of the particular pipe (e.g., 14 in FIG. 1) to which they are to be affixed. The stop collars 40, 42 may be similar in configuration to stop collars used in centralizers known in the art, for example, centralizers described in U.S. Pat. No. 6,457,519 issued to Buytaert. The stop collars 40, 42 may be affixed to the exterior of the pipe (14 in FIG. 1) using set screws 44 or any other device known in the art for such purpose. The stop collars 40, 42 may be maintained at a fixed selected distance from each other along the exterior of the pipe (14 in FIG. 1) by longitudinally extending, circumferentially spaced apart longitudinal spacers 46. The longitudinal spacers 46 may be positioned longitudinally between the stop collars 40, 42 and may be affixed to the stop collars 40, 42 at each longitudinal end of each longitudinal spacer 46. A selected number of longitudinal spacers, typically two or more, may be circumferentially evenly spaced about the circumference of the stop collars 40, 42. As may be inferred by reference to FIG. 2, the longitudinal spacers 46 may be in the form of strips and may be made from the same material used to make the stop collars 40, 42. The longitudinal spacers 46 need not traverse a great width ("width" as used herein the direction transverse to the length in the direction along the circumference of the centralizer) because they are substantially not load bearing. The stop collars 40, 42 may be affixed to the exterior of the pipe (14 in FIG. 1) so that any longitudinal loading is transferred to the device used to affix the stop collars to the exterior of the pipe (14 in FIG. 1). Thus, the longitudinal spacers 46 may be made of sufficiently small material thickness and width so as to provide only the required strength to fix the relative positions of the stop collars 40, 42 during shipment and assembly to the pipe (14 in FIG. 1).

The first stop collar 40 may include affixed thereto a plurality of longitudinally extending, circumferentially spaced apart blades or bow springs 52. The bow springs 52 may be made from spring steel and may be substantially the same configuration as used in conventional centralizers, e.g., those disclosed in the Buytaert '519 patent set forth above. The bow springs 52 may be affixed to the first stop collar 40 at one longitudinal end as shown in FIG. 2. The opposite longitudinal end of each of the bow springs 52 may be affixed to a first floating collar 50. The first floating collar 50 may be arranged to move longitudinally along the outside of the pipe (14 in FIG. 1) corresponding to the bow springs 52 being laterally compressed and relaxed. Thus, the first floating collar 50 can move longitudinally along the exterior of the pipe while the two stop collars 40, 42 remain longitudinally fixed with respect to each other and in a fixed position along the exterior of the pipe. The bow springs 52 coupled to the first stop collar 40 extend longitudinally in the direction of the second stop collar 42 as shown in FIG. 2, and typically terminate at a position between the two stop collars 40, 42. In some examples, the floating collars 48, 50 are disposed radially inside those of the bow springs coupled to the opposed stop collar 40, 42.

Correspondingly, bow springs 52 may be affixed at one longitudinal end thereof to the second stop collar 42. The other longitudinal end of such bow springs 52 may be affixed to a second floating collar 48 disposed between the two stop collars 40, 42. The second floating collar 48 moves longitudinally along the exterior of the pipe as the coupled bow springs 52 are compressed and relaxed in a manner corresponding to movement of the first floating collar 50. The bow springs 52 extending between the respective first 40, 50 and second 52, 48 collars each have length such that there is longitudinal overlap between the bow springs 52 coupled to the first stop collar 40 and those coupled to the second stop collar 42, and such overlapping bow springs 52 may be circumferentially arranged to avoid interference with each other. In one example, four bow springs 52 are coupled to the first stop collar 40 and four bow springs 52 are coupled to the second stop collar 42 providing a total of eight bow springs 52.

The bow springs 52 in the present example may have a tapered width (width herein being the direction transverse to the length of the bow spring and in the circumferential direction as explained with reference to the longitudinal spacers 46). Such taper may be observed in FIG. 2 as having a wider central portion 56 and as narrower longitudinal ends 54 where the bow springs 52 couple to the respective stop collar 40, 42. Such configuration of bow spring may reduce interference between the bow springs 52 and the longitudinal spacers 46 when the bow springs 52 are laterally compressed. In some examples, the central portion may be substantially ovoid. Such configuration may provide increased restoring force without substantially increasing the starting force and running force of the centralizer. The configuration of the bow springs 52 described above may provide the advantage of having three places along each bow spring where spring force originates. In prior art centralizers, most of the spring force is generated by flexure of the bow spring where it couples to a collar. In the present example, the central portion 56 of the bow springs 52 also provides spring force when the bow spring is compressed.

In some examples, the centralizer 10 may include eight bow springs, for connected to each of the first stop collar 40 and the second stop collar 42. Configured as shown in FIG. 2, the centralizer will have a substantially fixed length. In some examples, the bow springs 52 may be shaped as shown in FIG.

2 such that when the centralizer is radially fully compressed, the bow springs 52, the collars 40, 50, 48, 42 and the longitudinal spacers cooperatively engage with each other to form a metal to metal seal. A centralizer configured to provide such sealing capability may be moved through a wellbore sealing device such as a rotating control head while substantially preventing movement of wellbore fluid pressure longitudinally along the centralizer as is passes through the rotating control head. Thus, a centralizer made according to some aspects of the invention may be used with managed pressure wellbore operations such as managed pressure drilling and managed pressure casing cementing. See, for example, U.S. Pat. No. 6,904,981 issued to van Riet and U.S. Pat. No. 6,352,129 issued to Best for descriptions of such apparatus and methods.

A centralizer made as explained herein may provide increased restoring force, while minimizing increases in starting and running force as contrasted with alternative arrangements of a centralizer. Centralizers according to the invention may have higher reliability and durability than centralizers known in the art prior to the invention. A centralizer made according to the invention may have substantially constant axial length under all conditions of radial compression. The floating collars may be positioned in a manner to avoid exposure of moving parts on the centralizer to external objects such as the wellbore wall or wellbore devices during movement of a pipe. A centralizer according to the invention may be able to provide a fluid tight seal when compressed, enabling its use with wellbore pressure control devices such as rotating control heads. The bow springs of a centralizer made according to the invention may have three points at which spring force is generated as contrasted to only one or two for centralizers known in the art prior to the present invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A centralizer, comprising:

a first stop collar configured to be affixed to an exterior surface of a pipe;

a second stop collar spaced apart from the first stop collar and configured to be affixed to the exterior surface of the pipe;

a plurality of circumferentially spaced apart longitudinal spacers each coupled at each longitudinal end to one of the stop collars;

a first plurality of circumferentially spaced apart bow springs each coupled at one longitudinal end thereof to the first stop collar and at an opposite longitudinal end thereof to a first floating collar disposed between the first and second stop collars; and a second plurality of circumferentially spaced apart bow springs each coupled at one longitudinal end thereof to the second stop collar and at an opposite longitudinal end thereof to a second floating collar disposed between the first and second stop collars, wherein a shape of the first plurality of bow springs and the second plurality of bow springs is selected to cooperatively engage the longitudinal spacers and the floating collars such that when compressed the centralizer provides a substantially fluid-tight seal.

2. The centralizer of claim 1 wherein each of the bow springs comprises a tapered width that is a maximum substantially in a longitudinal center of each of the bow springs.

3. The centralizer of claim 1 wherein a central portion of each bow spring is ovoid shaped.

4. The centralizer of claim 1 wherein the bow springs are configured to generate spring force in a longitudinal center and at longitudinal ends thereof.

5. The centralizer of claim 1 wherein the floating collars are disposed laterally within those of the bow springs coupled to a one of the stop collars opposed to the bow springs coupled to the respective floating collar.

* * * * *